US005411456A

United States Patent [19]

Lay

[11] Patent Number: 5,411,456

[45] Date of Patent: May 2, 1995

[54] FOOT CRADLE EXERCISE APPARATUS

[76] Inventor: Kenneth G. Lay, P.O. Box 800, Edgartown, Mass. 02539

[21] Appl. No.: 79,327

[22] Filed: Jun. 18, 1993

[51] Int. Cl.[6] ..... A63B 23/00; A63B 23/02

[52] U.S. Cl. ..... 482/79; 482/145

[58] Field of Search ..... 482/79, 80, 145, 148

[56] References Cited

U.S. PATENT DOCUMENTS

| | | | |
|---|---|---|---|
| 3,567,218 | 3/1971 | Johnson | 482/145 |
| 4,508,335 | 4/1985 | Kelley et al. | 482/145 |
| 4,691,919 | 9/1987 | Roberson | 482/145 |
| 4,807,873 | 2/1989 | Naquin | 482/148 |
| 5,100,129 | 3/1992 | Porter et al. | 482/79 |
| 5,100,130 | 3/1992 | Shoebrooks | 482/145 |
| 5,190,513 | 3/1993 | Habing et al. | 482/145 |

*Primary Examiner*—Stephen R. Crow

*Attorney, Agent, or Firm*—Jerry Cohen; Edwin H. Paul

[57] ABSTRACT

Passive exercise apparatus with parallel bars for receiving the feet. The exercise equipment, or cradle, has extendible tubular construction wherein the distance between the parallel bars and the distance of the apparatus from the floor are adjustable. The cradle has attached adjustable-length straps which may be secured to the users feet to enhance the exercise. These straps are comprised of surgical-type tubing.

4 Claims, 2 Drawing Sheets

FOOT CRADLE EXERCISE APPARATUS

FIELD OF THE INVENTION

The present invention relates generally to exercise equipment, especially to passive equipment for the lower human extremities which, however, provides for therapeutic strengthening of the entire lower body.

BACKGROUND OF THE INVENTION

Exercise has well known therapeutic benefits, as the proliferation of exercise equipment for the home, office and gymnasium so attests. Much of the attention is focused on active exercise (where the body is in constant motion) equipment that has springs or the like for providing resistance to motion. Often such equipment is provided with articulated, movable joints to perform specialized workouts. Although the forgoing improvements are significant to the industry, limitations persist and other arrangements may be used to advantage. Passive devices, such as chinning bars and the like, have not had so much attention, and there has been few inventive innovations in such passive exercise equipment.

A limitation of active exercises is that, due to inertia, it takes less force to maintain a body in motion than to initiate the motion. Passive exercises, generally, require that a weight or body stop, reverse direction and start motion again. The subtle act of weight transference while the body is at rest will cause beneficial muscle contractions. These muscles contractions, in passive exercises, may be directed to parts of the body not often acted upon.

The bicycle exercise equipment found in virtually every workout area provides resistance to the foot pressing down on the pedal (as in bicycle riding), and a toe clip provides for resistance to the foot as the foot pulls the pedal upwards. The toe clip expands the therapeutic capabilities of the device in a limited way, but there is a need to expand and improve upon this device.

Another device called the "Roman Chair" which is designed especially for sit-ups that exercise the abdominal areas can be improved to extend exercise beyond the abdominal muscles.

Even common leg extension/press exercise equipment can be improved to provide for exercising more than the legs alone.

An important object of the present invention is to provide a beneficial passive exercise for the feet, ankles, legs and lower torso.

Another object of this invention is to provide a flexible apparatus which can be used at home, the office or in conjunction with other exercise equipment.

Another object of the present invention is to provide exercise for parts of the body often overlooked by other exercise equipment and other exercise routines, e.g., aerobics.

Another important object of this invention is to provide for expanded therapeutic capabilities for bicycle exercise and leg extension/press machines. It is yet another object of this invention to provide for low cost exercise apparatus.

SUMMARY OF THE INVENTION

The foregoing objects are met in an apparatus which receives one or both feet. The force needed to drive the foot downward, forward and/or rearward provides exercise for the leg muscles, the ankle muscles, the foot muscles, and the stomach and lower back muscles.

The passive exercise apparatus comprises: first support means arranged and constructed for receiving the bottom of one or both feet, second support means arranged and constructed for receiving the back of the lower leg (or ankle) of one or both legs, and means to hold the first and second support means above and fixed relative to the floor, where one or both feet may exert pressure downward into the floor, outward away from the body, inward toward the body, and where one or both legs may be lifted above said apparatus. For the purposes of this invention the lower leg is defined to include the ankle.

This invention is implemented as an improvement for existing exercise leg extension/press exercise equipment and for similar machines. A second support means is provided for receiving the back of the ankle or foot. This second support means is attach to the pad which already exists on the leg press where the sole of the foot is placed. The advantage provided by this embodiment of the present invention is that a downward direction by the ankle pressing on the second support means provides for translating the force required to the users hip area, allowing the user to develop a forward pelvic tilt.

This invention is implemented as an improvement for existing exercise equipment. In particular for a bicycle machine the pedal on the receives the bottom of a foot and an extension is provided with a second support means for receiving the back of the lower leg or ankle. In use the foot presses driving the pedal down, but on the return or upward motion of the pedal the heel and/or the back of the ankle of the foot (rather than the toe when a toe clip is used) pulls the pedal back to the starting position. The advantage provided is that the pulling with the ankle allows the user to exercise more parts of the body than with the existing bicycle apparatus and increases the power generated.

The present invention has advantages when used with the Roman Chair. Advanced Roman Chairs have springs and pads for increased resistance and comfort. But, the toe/foot straps, provided to immobilize the lower half of the body as one exercises, require tension in the foot/ankle/shin areas which is translated in a "negative way" through the knee and hip areas. "Negative" herein refers to an action which diminishes the exercise value to the abdominals. Use of the present invention rather than the toe/foot straps removes virtually all of the unwanted tension through the foot/ankle/shin and so relieve the above negative effects.

In preferred embodiments the first and second support means comprise parallel tubular structures. In another preferred embodiment means for securing the parallel tubular structures to each other are provided, and the securing means may be constructed to be adjustable to allow a variable separation between said first and second parallel tubular structures. This parallel design provides a geometric mechanical feature with particular advantages for leg extension and leg curl exercises not found in prior art.

In a preferred embodiment, the tubular construction provides padding upon which the feet or foot may be placed and supported. In another preferred embodiment, the tubular legs are extendible such that the position of the foot, when in contact with the apparatus, may be lowered or raised. In the lower position the exercise emphasis is on the muscles of the leg, ankle and foot, while in a raised position the exercise emphasis is on the muscles of the stomach and lower back.

In another preferred embodiment straps made of surgical-type tubing are provided for holding the foot to the foot rest apparatus which increases the resistance to the leg. In a preferred embodiment the straps are secured with a loops and hooks material and the loops are secured by removable clips to the foot rest.

Other objects, features and advantages will be apparent from the following detailed description of preferred embodiments thereof taken in conjunction with the accompanying drawings in which:

DETAILED DESCRIPTION OF PREFERRED EMBODIMENTS

Figure 1:
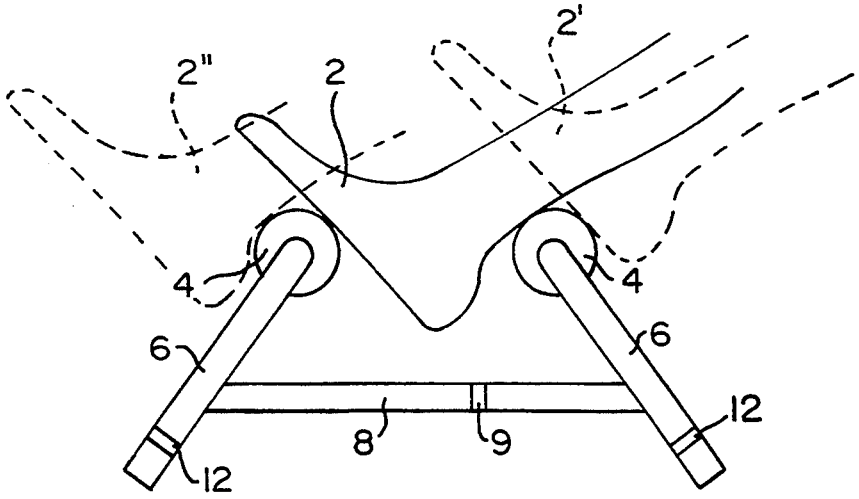
FIG. 1 is side view of the foot cradle showing the relationship of the foot.

FIG. 1 is a side view of apparatus, referred to as a foot cradle, in accordance with the present invention. The human feet in position 2 contacts the padded tubular rests 4. The feet, as shown in position 2, can exert pressure downward and forward and backward for isometric type exercises. But benefit is also attained by motion. One foot can remain on the rest while the other leg is lifted. This action intensifies exercise for the stomach and hip muscles. The rests are supported by tubular, extendible legs 6. A tube within a tube construction 12 is used with the tubes secured in position by methods known in the art. For example, one tube may be threaded into the other with a locking ring, cotter pins through aligning holes in each tube, securing nut/bolts, and the like. There are tubular braces 8 which support the two rests to each other. A space 14 is provided between the braces 8 which allows the heel of each foot to pass between the support braces.

Still referring to FIG. 1, one foot may be positioned at 2' while the other remains at position 2. Leg raises with this relative positioning of the legs provides an exercise similar to stair climbing, especially when the legs are alternated between position 2 and 2'. Special emphasis is placed on the stomach muscles and the anterior and posterior leg muscles. In addition lateral torsion through the hips is provided. One or both legs may be extended to position 2'' where similar exercises are available, but since the legs are extended farther more leverage and therefore greater force is needed to perform the leg lifts.

Figure 2:
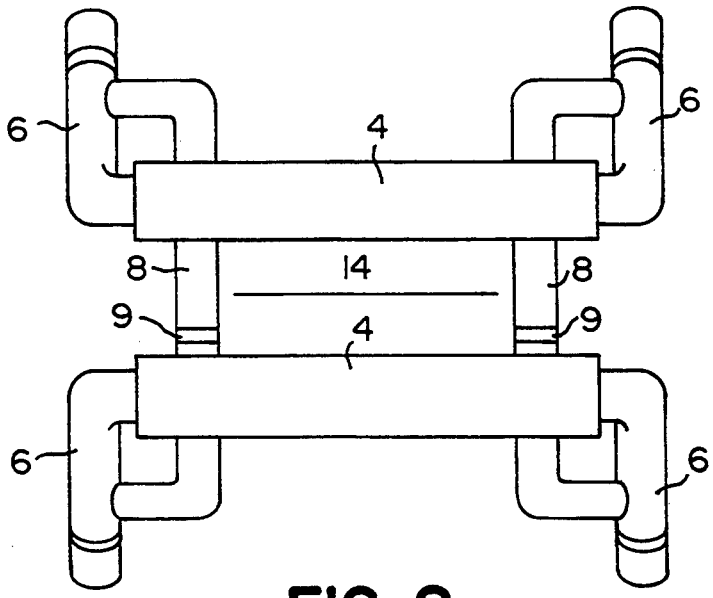
FIG. 2 is top view of the foot cradle.

The support braces 8 are adjustable to accommodate different feet. An adjustment 9 is shown in FIG. 1 and 2. This may be a locking threaded screw arrangement, holes/cotter pins, nuts and bolts, or the like.

Figure 3:
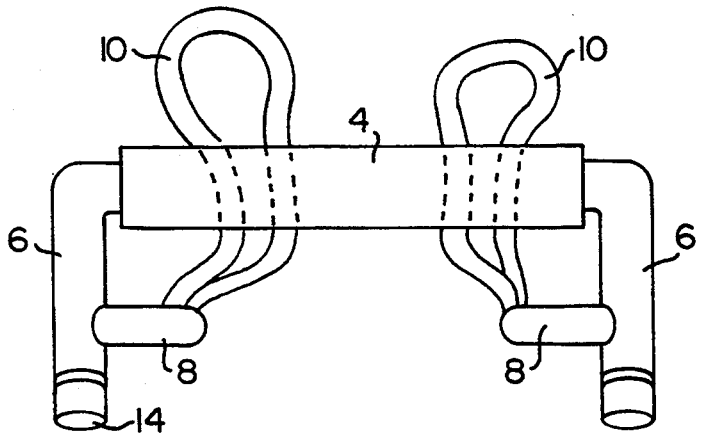
FIG. 3 is another side view of the foot cradle.

FIG. 3 is a side view showing the addition of straps 10. These padded straps are made of comfortable material composed of surgical-type tubing which are attached around the foot or lower leg. In this position the straps are long enough such that the strapped-in foot may be raised, breaking contact with the rest 4, and then restrained from raising any farther by the strap.

The exercise device is designed to remain motionless when in use. In one preferred embodiment each leg has a rubber tip 14 at the end in contact with the floor. In other preferred embodiments wider pads 16 are used.

Figure 4:
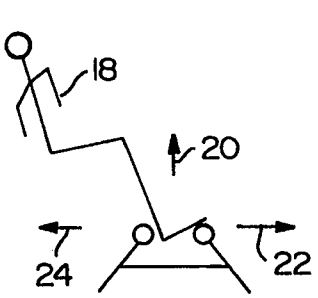
FIGS. 4–7 is a stick figure pictorial of the cradle and the human user.

FIGS. 4–7 diagrams the device showing the relationship and exercise positions of a human user 18. In FIG. 4 both feet are resting between the rests. In this position pushing in the direction 22 exercises the anterior leg muscles, while pulling in direction 24 exercises the posterior thighs and calf muscles, and lifting 20 exercises the anterior thighs, hips and lower abdominal muscles. If both legs are raised 20 the stomach and anterior hips are exercised.

Figure 5:
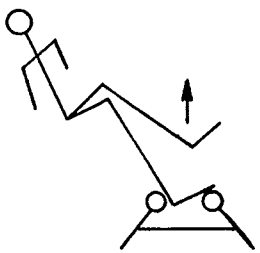

In FIG. 5 single leg lifts exercise the abdominals, anterior thighs and the posterior thigh of the supporting leg (the not lifted leg).

Figure 6:
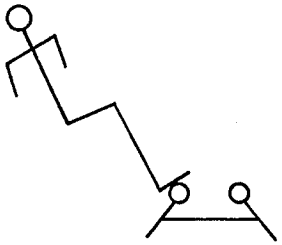

In FIG. 6, the feet are forward in the cradle. In this position a pelvic tilt occurs which exercises the abdominals and stretches the lower back.

Figure 7:
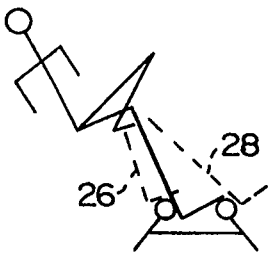

In FIG. 7, hip stretches, rotation, lateral hip torsion, stomach contraction and calf stretching occur. The leg(s) may be positioned as shown between the rests of the cradle or forward 26 or farther away 28 to increase force or exercise other muscles.

Figure 8:
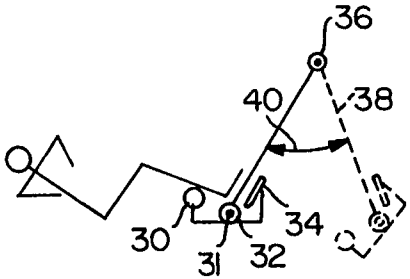
FIG. 8 is a stick figure pictorial of the cradle invention as an extension attached to a leg press exercise machine.

Referring to FIG. 8, the present invention is shown as applied to a leg press. The sole plate 34 receives the bottom of the foot and the padded rail 30 receives the back of the ankle. The press is pivoted 36 and moves away to 38 and then returns 40 as the user extends the legs and then returns the legs to the original position. The rail 30 is attached to the sole plate 34 by a member 32. In other preferred embodiments the member 32 is constructed to slightly pivot 31 about an axis to accommodate the foot and the users body position. The user presses downward against rail 30 with the back of the ankle and Achilles tendon. While doing this the hip and lower abdomen muscles are used providing exercise for these muscles which is not provided by the leg press alone. The resulting pelvic tilt is recognized as therapeutic.

Other preferred embodiments may be made by similar attaching of the passive padded ankle support to other known exercise equipment, or in some cases by attaching an added padded sole support to existing exercise equipment where the heel/ankle support already exists.

Figure 9:
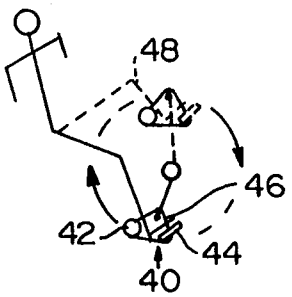
FIG. 9 is a stick figure pictorial of the cradle as applied to a bicycle machine.
Figure 10:
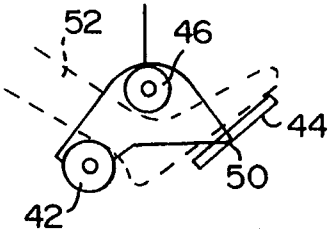
FIG. 10 is a detail of the foot cradle as applied to the bicycle machine.

Another preferred embodiment is shown in FIG. 9 where the present invention, the foot cradle 40, is applied to a bicycle machine (or to a bicycle itself). In the lower position the foot sole rests on the bicycle pedal 44 and the ankle is supported by the padded rail 42. The rail 42 is attached to the pedal by a pivot 46 to accommodate different user's anatomy and comfort. FIG. 10 shows the detail of the cradle. The foot is dotted 53 with the ankle resting on the rail 42 and the sole of the foot on the pedal 44. The pivot 46 allow the users to position the angle of the users leg to the cradle to provide for comfort and to allow the ankle to securely engage the rail 42. The pedal 44 itself is pivoted 50 in most cases. The foot presses down to drive the pedal to the lower position and on the upward stroke towards position 48 the heel and ankle pull the mechanism upward by pressing against the rail 42. This backward pulling on the upward stroke provides added exercise and therapeutic benefits to the back of the legs which is not provided in the existing bicycle machine even with toe clips.

Figure 11:
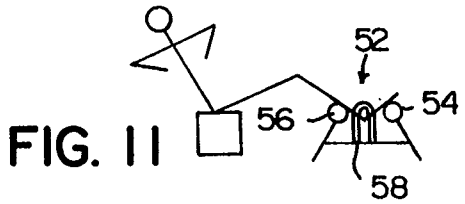
FIG. 11 is a pictorial of an improved Roman Chair.
Figure 12:
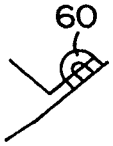
FIG. 12 is a pictorial of a conventional Roman Chair toe restraint.

FIG. 11 shows the present invention 52 with a strap 58 securing the foot to the apparatus. The back of the ankle rests on the padded rail 56 and the sole of the foot on the padded rail 54. The strap and the two rails provide a three point anchoring system. The three points engage and fully immobilize the tops of the ankles while the padded rails support the bottom of the foot and the back of the ankles. In the embodiment the present invention (the foot cradle) must be anchored to the floor. Compare this to FIG. 12 which shows the toe strap of the conventional Roman Chair.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. Exercise apparatus comprising:

first support means arranged and constructed for receiving the bottom of one or both feet, second support means arranged and constructed for receiving the back of the lower leg of one or both legs, adjustable means for horizontally spacing the second support means from the first support means such that the bottom of one or both feet and the back of one or both lower legs simultaneously contact the first and second support means, said spacing being less than about one and one-half lengths of a human foot, and first adjustable means for holding the first support means above the floor, where the first adjustable means is constructed and arranged to vertically raise or lower the first support means, and second adjustable means for holding the second support means above the floor, where the second adjustable means is constructed and arranged to vertically raise or lower the second support means, wherein either support means may be positioned higher than the other support means, and where each adjustable means for holding has one end in contact with the floor and another end contacting the support means, and where both support means are held at about ankle height above the floor, and where one or both feet may exert pressure downward into the floor, outward away from the body, inward toward the body, and where one or both legs may be lifted above said apparatus.

2. Apparatus as defined in claim 1 further comprising strap means are removably attached to said apparatus arranged and constructed for retaining the leg/foot to the exercise apparatus.

3. Apparatus as defined in claim 2 wherein said strap means is comprised of surgical-type tubing constructed to allow the retained leg/foot to freely move only an adjustable distance from the support means.

4. Apparatus as defined in claim 1 wherein the first and the second support means defines a plane, and wherein the hips of the user may be positioned from a point about on this plane to a point above this plane.

* * * * *